US007127836B1

(12) United States Patent
Jamison

(10) Patent No.: US 7,127,836 B1
(45) Date of Patent: Oct. 31, 2006

(54) SHOE AND BOOT PROTECTING ASSEMBLY

(76) Inventor: John R. Jamison, 1217 Concord Rd. P. O. Box 1027, Gaffney, SC (US) 29342

( * ) Notice: Subject to any disclaimer, the term of this patent is extended or adjusted under 35 U.S.C. 154(b) by 82 days.

(21) Appl. No.: 10/987,910

(22) Filed: Nov. 15, 2004

(51) Int. Cl.
*A43B 3/20* (2006.01)

(52) U.S. Cl. ..... 36/72 R; 36/1.5; 36/7.2

(58) Field of Classification Search ..... 36/72 R, 36/1.5, 2 B, 2 R; D2/910, 911, 913
See application file for complete search history.

(56) References Cited

U.S. PATENT DOCUMENTS

| | | | | |
|---|---|---|---|---|
| 806,439 | A | 12/1905 | Smyth | |
| 2,555,900 | A | 6/1951 | Roberts | |
| 3,250,025 | A | 5/1966 | Crescent | |
| 4,057,853 | A * | 11/1977 | McLane | 2/22 |
| D252,296 | S | 7/1979 | Alegria | |
| 4,361,970 | A | 12/1982 | Wren, Jr. et al. | |
| 4,825,563 | A | 5/1989 | Strongwater | |
| 5,469,637 | A * | 11/1995 | Adam | 36/2 R |
| 5,638,614 | A | 6/1997 | Hardy | |
| 5,845,416 | A | 12/1998 | Hands | |
| 5,873,185 | A | 2/1999 | Harris et al. | |
| 5,987,778 | A | 11/1999 | Stoner | |
| 5,996,258 | A | 12/1999 | Simmons | |
| D425,672 | S * | 5/2000 | Ayala | D2/901 |

FOREIGN PATENT DOCUMENTS

FR 2587176 A1 * 3/1987

* cited by examiner

*Primary Examiner*—Ted Kavanaugh

(57) ABSTRACT

A shoe and boot protecting assembly includes a foot portion with a top wall. A front wall, a first side wall and a second side wall are each integrally attached to and extend downwardly from the top wall. An ankle portion includes a forward wall that has a lower edge, and upper edge, a first lateral edge and a second lateral edge. The lower edge is integrally attached a back edge of the top wall. A first lateral wall is attached to the first lateral edge and is orientated parallel with the first side wall. A second lateral wall is attached to the second lateral edge and is orientated parallel with the second side wall. Each of a plurality of couplers is attached to the ankle and foot portions. The couplers are adapted for releasably securing the foot and ankle portions on a foot covering.

8 Claims, 5 Drawing Sheets

SHOE AND BOOT PROTECTING ASSEMBLY

BACKGROUND OF THE INVENTION

1. Field of the Invention

The present invention relates to foot covering protection devices and more particularly pertains to a new foot covering protection device for protecting foot coverings from damage due to impacts from scuffs and falling materials.

2. Description of the Prior Art

The use of foot covering protection devices is known in the prior art. U.S. Pat. No. 806,439 describes a flexible panel that is positionable on a shoe or boot for protecting the shoe or boot from scuffs an the like. Another type of foot covering protection device is U.S. Pat. No. 3,250,025 having the general shape of shoe with the sole missing so that it may be slipped over a conventional shoe. A similar device is found in U.S. Pat. No. 4,361,970 which is worn directly on a foot for softening a blow while performing fighting kicks.

While these devices fulfill their respective, particular objectives and requirements, the need remains for a device that can be worn over a boot or shoe and which does not include a back wall or a bottom wall so that the device may be easily positioned on or taken off of the boot or shoe. The device is preferably constructed of a rigid mater to protect not only the boot or shoe from scuffs but also a foot contained therein from impact injuries.

SUMMARY OF THE INVENTION

The present invention meets the needs presented above by generally comprising a foot portion that includes a top wall that is generally rectangular shaped and has a front edge, a first side edge, a second side edge and a back edge. A front wall is integrally attached to and extends downwardly from the front edge. A first side wall and a second side wall are integrally attached to and extend downwardly from a respective one of the first and second side edges. Each of the first and second side walls is integrally coupled to the front wall. An ankle portion includes a forward wall that has a lower edge, and upper edge, a first lateral edge and a second lateral edge. The lower edge is integrally attached the back edge of the top wall. A first lateral wall is attached to the first lateral edge. The first lateral wall is orientated parallel with and is integrally attached to the first side wall. A second lateral wall is attached to the second lateral edge. The second lateral wall is orientated parallel with and is integrally attached to the second side wall. Each of a plurality of couplers is attached to the ankle and foot portions. The couplers are adapted for releasably securing the foot and ankle portions on the foot covering.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
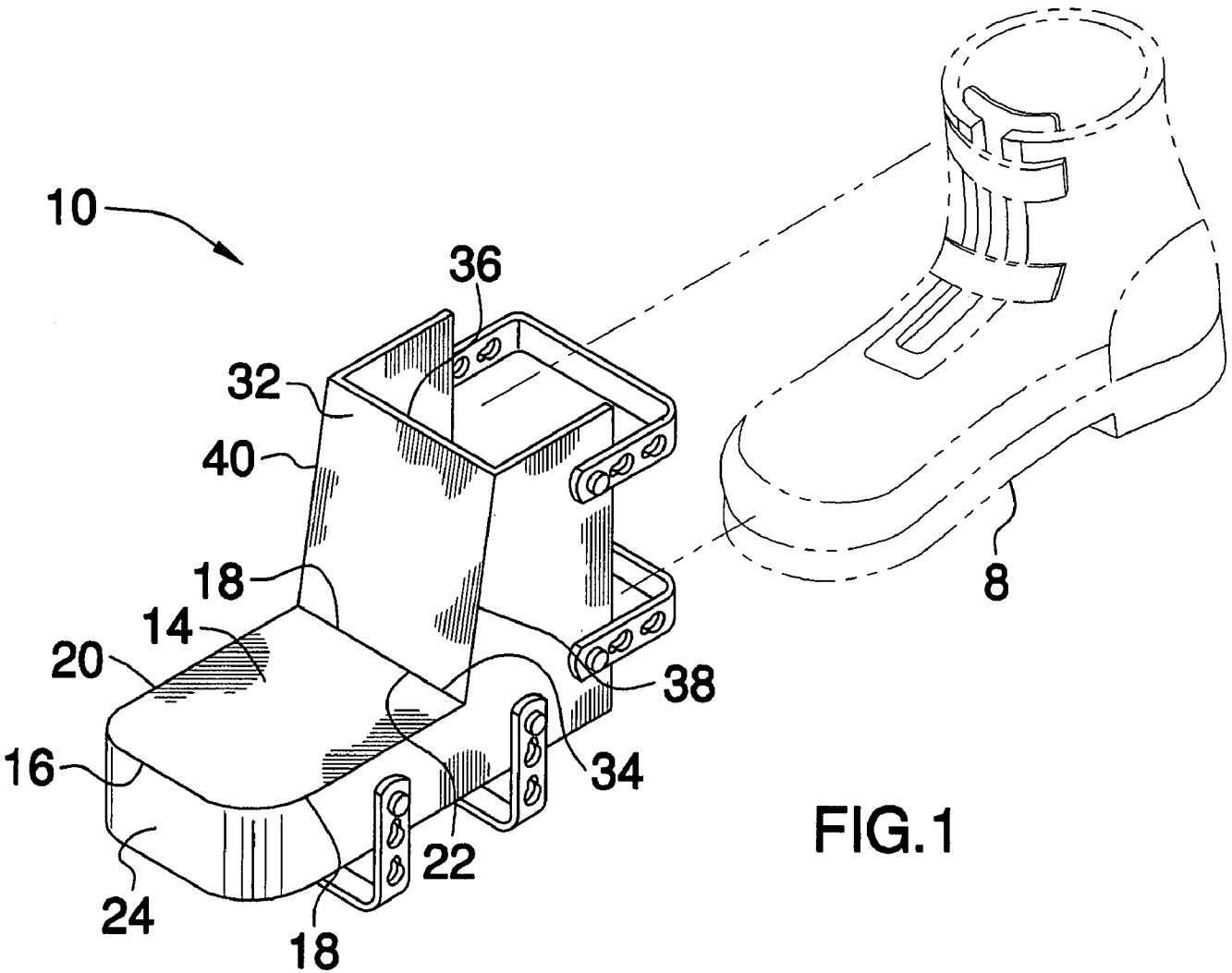
FIG. 1 is a perspective view of a shoe and boot protecting assembly according to the present invention.
Figure 2:
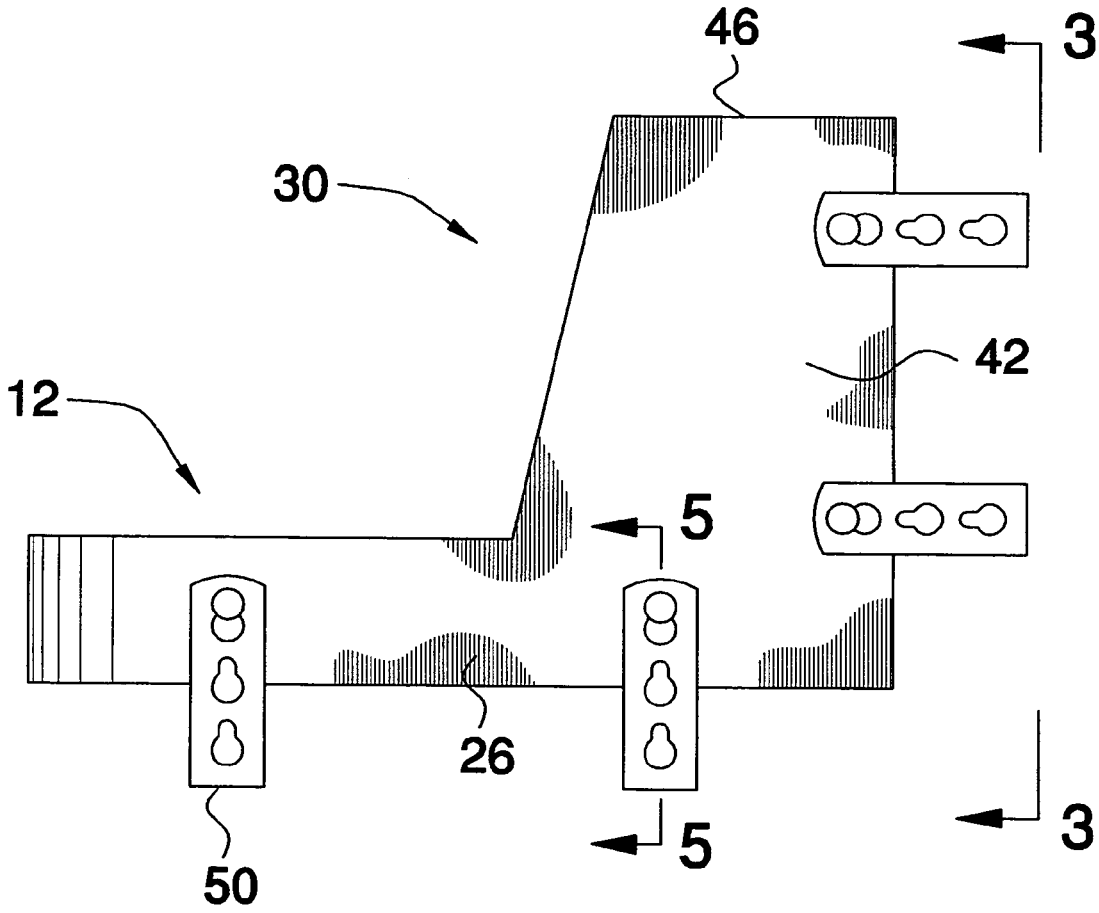
FIG. 2 is a side view of the present invention.
Figure 3:
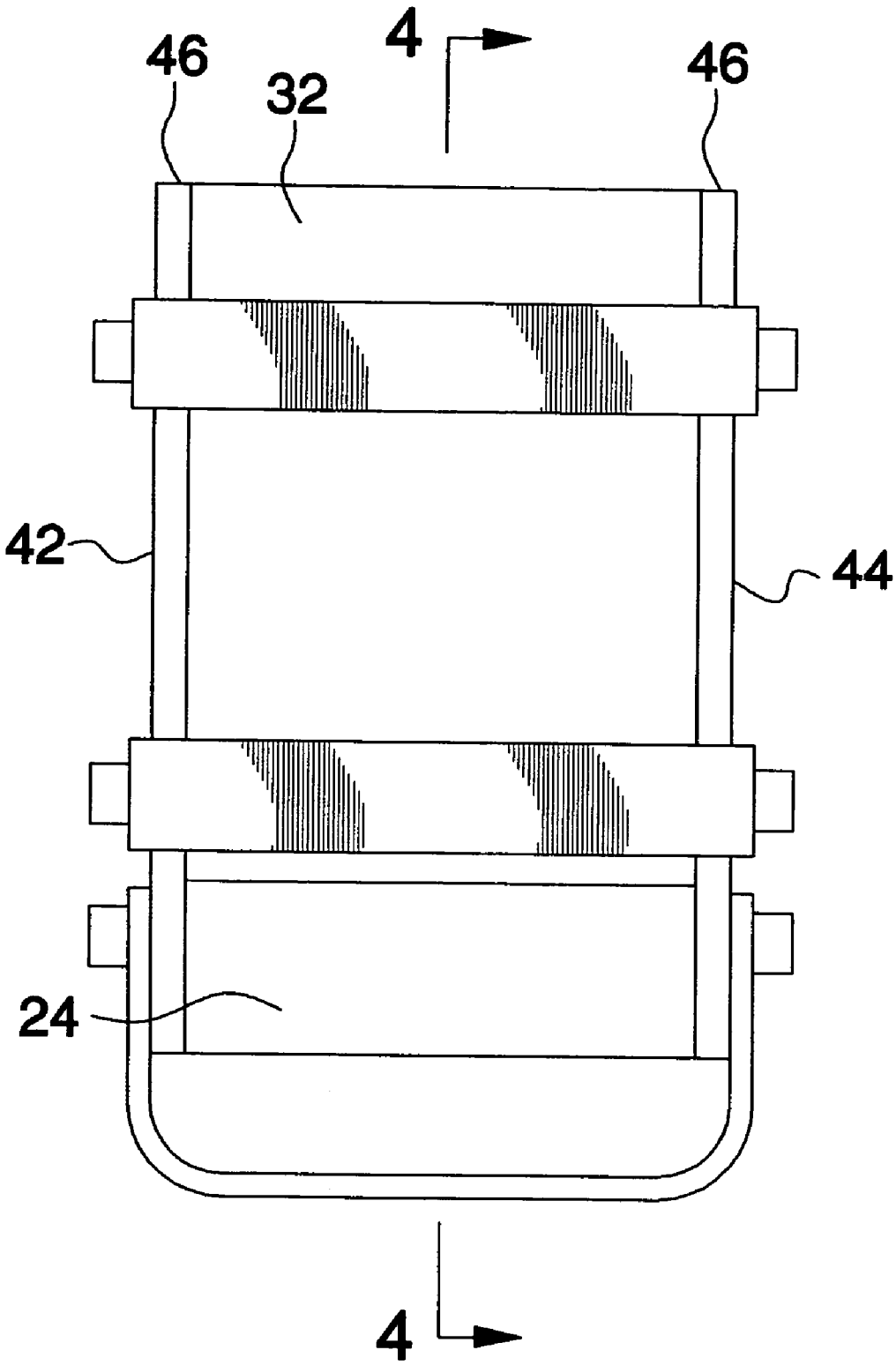
FIG. 3 is a back rear view of the present invention.
Figure 4:
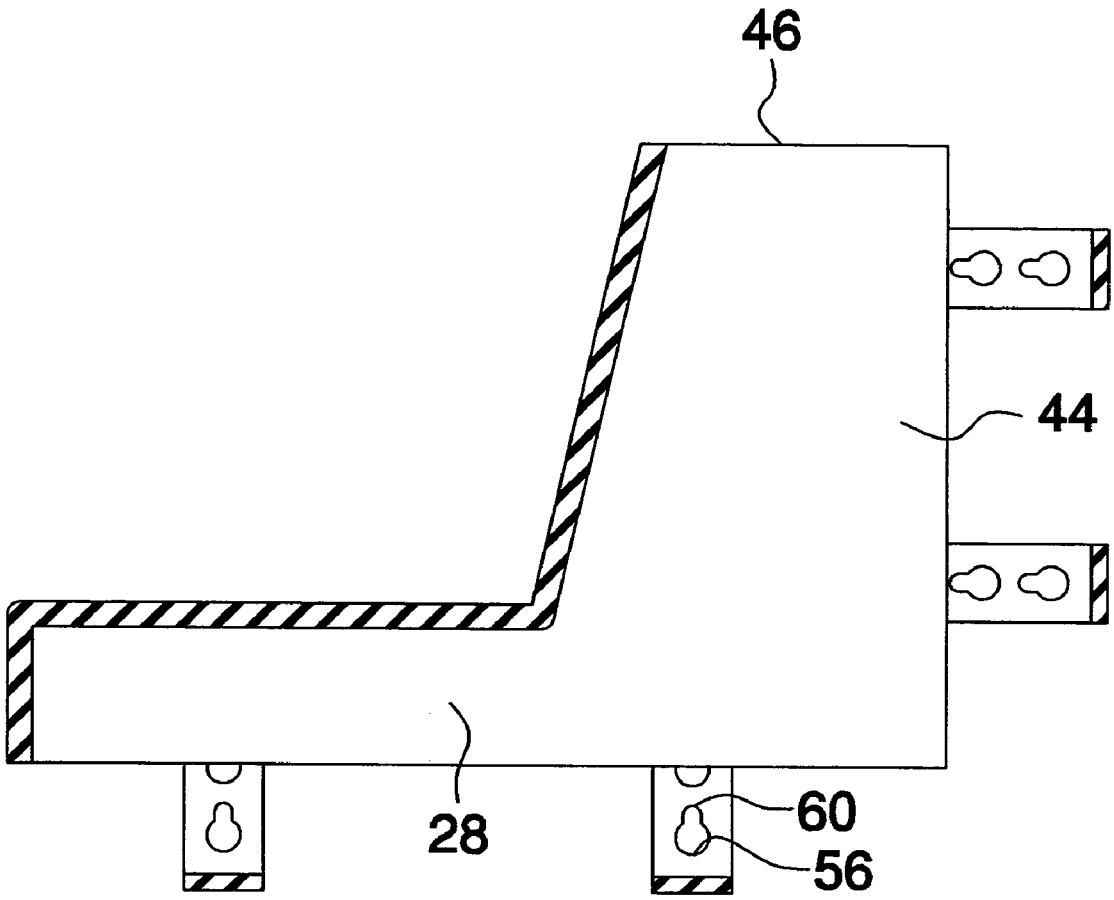
FIG. 4 is a cross-sectional view of the present invention.
Figure 5:
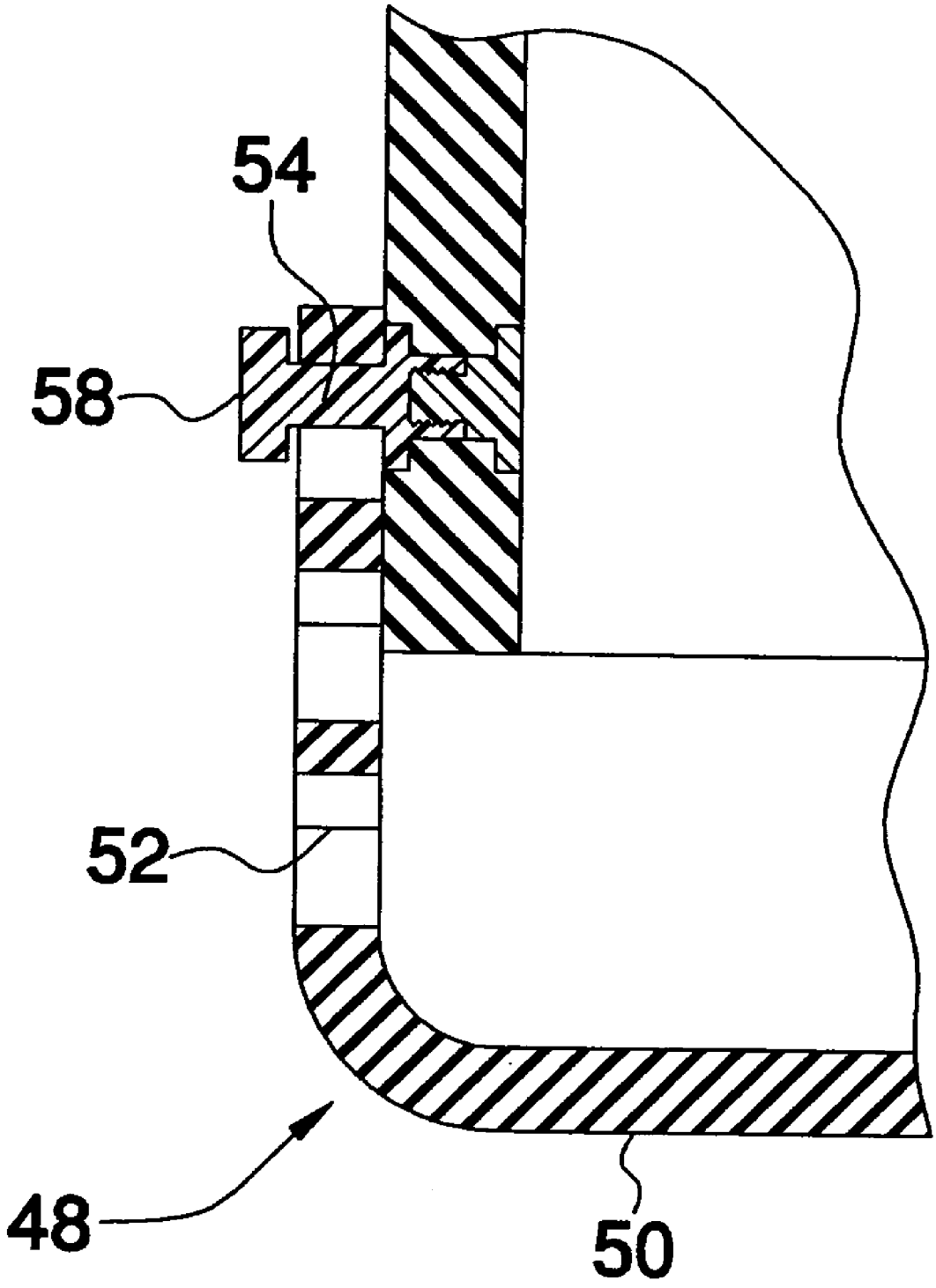
FIG. 5 is a cross-sectional view taken along line 5—5 of FIG. 2 of the present invention.

With reference now to the drawings, and in particular to FIGS. 1 through 5 thereof, a new foot covering protection device embodying the principles and concepts of the present invention and generally designated by the reference numeral 10 will be described.

As best illustrated in FIGS. 1 through 5, the shoe and boot protecting assembly 10 generally comprises a foot portion 12 that includes a top wall 14 that is generally rectangular shaped and has a front edge 16, a first side edge 18, a second side edge 20 and a back edge 22. A front wall 24 is integrally attached to and extends downwardly from the front edge 16. A first side wall 26 and a second side wall 28 are integrally attached to and extend downwardly from a respective one of the first 18 and second 20 side edges. Each of the first 18 and second 20 side walls is integrally coupled to the front wall 24. The top wall 14 is generally perpendicularly orientated with respect to the front wall 24, the first wall 26 and the second wall 28. Each of the front 24, first side 26 and second side 28 walls has a height generally between 2 inches and 4 inches. The top wall 14 has a width from the first side edge 18 to the second side edge 20 generally equal to between 4 inches and 6 inches. The top wall 14 has a length from the front edge 16 to the back edge 22 generally between 5 inches and 7 inches.

An ankle portion 30 includes a forward wall 32 that has a lower edge 34, and upper edge 36, a first lateral edge 38 and a second lateral edge 40. The lower edge 34 is integrally attached to the back edge 22 of the top wall 14 so that the forward wall 32 extends upwardly from the top wall 14. An angle formed by the forward wall 32 and the top wall 14 is generally between 80 degrees and 120 degrees. A first lateral wall 42 is attached to the first lateral edge 38. The first lateral wall 42 is orientated parallel with and is integrally attached to the first side wall 26. A second lateral wall 44 is attached to the second lateral edge 40. The second lateral wall 44 is orientated parallel with and is integrally attached to the second side wall 28. Each of the first 42 and second 44 lateral walls has a top edge 46 that is co-planar with the upper edge 36 of the forward wall 32. Each of the first 42 and second 44 lateral walls has a height generally between 6 inches and 12 inches. Each of the foot 12 and ankle 30 portions are preferably comprised of a rigid material, such as a plastic or metal, though elastomeric material may also be used.

A plurality of couplers 48 are attached to the ankle 30 and foot 12 portions for attaching the ankle 30 and foot 12 portions to afoot covering 8 such as a shoe or boot. The couplers 48 each preferably include a strap 50. Each of the straps 50 has a plurality of openings 52 therein. Each of a plurality of posts 54 is attached to one of the foot 12 and ankle 30 portions. It is preferred that at least two posts 54 are positioned on each of the first side wall 26, the second side wall 28, the first lateral wall 42 and the second lateral wall 44. Each of the straps 50 is selectively couplable between two posts 54 so that straps 50 extend under the foot portion 12 and behind the ankle portion 30 to secure the foot covering 8 in abutment with the foot 12 and ankle 30 portions. The openings 52 preferably each include a large section 56 for receiving a nub 58 on each of the posts 54 and notches 60 therein for receiving and seating the posts 54.

In use, the foot covering 8 is positioned under the foot 12 and ankle 30 portions so that the straps 50 secure the foot 12 and ankle portions 30 on the foot covering 12. The assembly 10 protects the foot covering 8 from damage due to falling objects and from scuffs. Additionally, the assembly 10 will protect the foot of its wearer from impact injuries. The straps 50 and open bottom and back allow for easy removal or mounting of the assembly 10.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A foot covering protection device, said device being removably positionable on a foot covering, said device including:

a foot portion including a top wall being generally rectangular shaped and having a front edge, a first side edge, a second side edge and a back edge, a front wall being integrally attached to and extending downwardly from said front edge, a first side wall and a second side wall being integrally attached to and extending downwardly from a respective one of said first and second side edges, each of said first and second side walls being integrally coupled to said front wall;

an ankle portion including a forward wall having a lower edge, and upper edge, a first lateral edge and a second lateral edge, said lower edge being integrally attached said back edge of said top wall, a first lateral wall being attached to said first lateral edge, said first lateral wall being orientated parallel with and being integrally attached to said first side wall, a second lateral wall being attached to said second lateral edge, said second lateral wall being orientated parallel with and being integrally attached to said second side wall, each of said foot and ankle portions being comprised of a rigid material;

a plurality of couplers being attached to said ankle and foot portions, said couplers being adapted for releasably securing the foot and ankle portions on the foot covering.

2. The device according to claim 1, wherein said top wall is generally perpendicularly orientated with respect to said front wall.

3. The device according to claim 1, wherein each of said front, first side and second side walls has a height generally between 2 inches and 4 inches, said top wall having a width from said first side edge to said second side edge generally equal to between 4 inches and 6 inches, said top wall having a length from said front edge to said back edge generally between 5 inches and 7 inches.

4. The device according to claim 1, wherein an angle formed by said forward wall and said top wall is generally between 80 degrees and 120 degrees.

5. The device according to claim 4, wherein each of said first and second lateral walls having a top edge being co-planar with said upper edge of said forward wall.

6. The device according to claim 5, wherein each of said first and second lateral walls having a height generally between 6 inches and 12 inches.

7. A foot covering protection device, said device being removably positionable on a foot covering, said device including:

a foot portion including a top wall being generally rectangular shaped and having a front edge, a first side edge, a second side edge and a back edge, a front wall being integrally attached to and extending downwardly from said front edge, a first side wall and a second side wall being integrally attached to and extending downwardly from a respective one of said first and second side edges, each of said first and second side walls being integrally coupled to said front wall;

an ankle portion including a forward wall having a lower edge, and upper edge, a first lateral edge and a second lateral edge, said lower edge being integrally attached to said back edge of said top wall, a first lateral wall being attached to said first lateral edge, said first lateral wall being orientated parallel with and being integrally attached to said first side wall, a second lateral wall being attached to said second lateral edge, said second lateral wall being orientated parallel with and being integrally attached to said second side wall, each of said foot and ankle portions being comprised of a rigid material;

a plurality of straps, each of said straps having a plurality of openings therein;

a plurality of posts, each of said posts being attached to one of said foot and ankle portions, wherein at least two posts are positioned on each of said first side wall, said second side wall, said first lateral wall and said second lateral wall, each of straps being selectively couplable between two posts; and wherein the foot covering may be positioned under the foot and ankle portions such that said straps secure foot and ankle portions on the foot covering.

8. A foot covering protection device, said device being removably positionable on a foot covering, said device including:

a foot portion including a top wall being generally rectangular shaped and having a front edge, a first side edge, a second side edge and a back edge, a front wall being integrally attached to and extending downwardly from said front edge, a first side wall and a second side wall being integrally attached to and extending downwardly from a respective one of said first and second side edges, each of said first and second side walls being integrally coupled to said front wall, said top wall being generally perpendicularly orientated with respect to said front wall, said first wall and said second wall, each of said front, first side and second side walls having a height generally between 2 inches and 4 inches, said top wall having a width from said first side edge to said second side edge generally equal to between 4 inches and 6 inches, said top wall having a length from said front edge to said back edge generally between 5 inches and 7 inches;

an ankle portion including a forward wall having a lower edge, and upper edge, a first lateral edge and a second lateral edge, said lower edge being integrally attached said back edge of said top wall, an angle formed by said forward wall and said top wall being generally between 80 degrees and 120 degrees, a first lateral wall being attached to said first lateral edge, said first lateral wall being orientated parallel with and being integrally attached to said first side wall, a second lateral wall being attached to said second lateral edge, said second lateral wall being orientated parallel with and being integrally attached to said second side wall, each of said first and second lateral walls having a top edge being co-planar with said upper edge of said forward wall, each of said first and second lateral walls having a height generally between 6 inches and 12 inches, each of said foot and ankle portions being comprised of a rigid material;

a plurality of straps, each of said straps having a plurality of openings therein;

a plurality of posts, each of said posts being attached to one of said foot and ankle portions, wherein at least two posts are positioned on each of said first side wall, said second side wall, said first lateral wall and said second lateral wall, each of straps being selectively couplable between two posts; and wherein the foot covering may be positioned under the foot and ankle portions such that said straps secure foot and ankle portions on the foot covering.

* * * * *